United States Patent [19]

Bernard et al.

[11] Patent Number: 4,916,866

[45] Date of Patent: Apr. 17, 1990

[54] END MILL SHARPENER

[75] Inventors: David A. Bernard, Ashland; William C. Christian, Medford, both of Oreg.

[73] Assignee: Darex Corporation, Ashland, Oreg.

[21] Appl. No.: 307,993

[22] Filed: Feb. 9, 1989

[51] Int. Cl.[4] ..... B24B 3/06; B24B 19/04; B24B 5/02

[52] U.S. Cl. ..... 51/95 LH; 51/218 T; 51/219 R; 51/123 R

[58] Field of Search ..... 51/123 R, 94 CS, 95 LH, 51/121, 123 R, 124 R, 219 R, 218 A, 48 R, 95 R, 219 PC, 95 WH, 122, 168, 169, 218 T

[56] References Cited

U.S. PATENT DOCUMENTS

| | | | |
|---|---|---|---|
| 2,052,567 | 9/1936 | Haines | 51/95 LH |
| 2,569,855 | 10/1951 | Hertlein | 51/123 R |
| 3,057,122 | 1/1960 | Hewes et al. | 51/219 R |
| 3,776,609 | 12/1973 | Pichette | 308/9 |

FOREIGN PATENT DOCUMENTS 2051281 10/1970 Fed. Rep. of Germany ... 51/95 LH

OTHER PUBLICATIONS

Brochure of the "Cuttermaster End Mill Sharpener" by HDT International.

*Primary Examiner*—Frederick R. Schmidt
*Assistant Examiner*—Bruce P. Watson
*Attorney, Agent, or Firm*—Kerkam, Stowell, Kondracki & Clarke

[57] ABSTRACT

An end mill resharpening device is provided which will resharpen the primary and secondary cutting edges of both the flutes and the end of the mill. All of the proper side and end angles, as well as an end "fish-tail" angle are produced automatically by the unique features of the device. Additional benefits provided include a novel method of making an air bearing, a floating spindle knob and grinding wheel balancer.

11 Claims, 9 Drawing Sheets

END MILL SHARPENER

This invention is directed to an apparatus for resharpening general purpose end mills.

BACKGROUND OF THE INVENTION

End mills are manufactured in a variety of diameters, lengths, and materials. End mills are expensive and for example, a basic set of six end mills having three quarter inch shanks, of regular length and for example, four to six flutes with diameters ranging from three quarters inch to one and one half inches may cost over $100.00.

It is important for machine shops to have available apparatus for sharpening end mills as it is virtually impossible to hand sharpen end mills to have the proper primary and secondary reliefs and clearances. Improperly sharpened end mills greatly reduce the cutting efficiency and chip handling ability.

THE INVENTION

The present invention provides an end mill resharpener which resharpens the lands and the tips of end mills.

The apparatus provides a stylus fixture which automatically compensates for tool diameter to produce the correct cutting edge angle on the end mill flutes and a stylus fixture which is provided with a slide action to produce a secondary clearance angle on the flutes and a fixture which is independent of the end mill sharpener spindle which reduces set up time.

A further object is to provide an apparatus having means for lowering and raising the spindle height to produce the primary and secondary clearance angles at the end of the end mill.

A further object is to provide a compound thread mechanism on the means for moving the motor and its attached grinding wheel which permits the grinding wheel to be moved away from the end mill prior to sharpening the second et cetera flutes without disturbing the primary setting of the grinding wheel in respect to the end mill to be resharpened.

A further utility of the end mill sharpener is its built in means for producing the two degree "fish tail" when sharpening the end of the end mill.

A further unique object of the present invention is to provide an end mill resharpener which will sharpen substantially any length end mill without touching the other side of a cup grinding wheel and to allow a guard to cover most of the face of the grinding wheel.

Other objects and advantages of the invention are provided in an end mill resharpening device generally comprising a base having a fixture mounted for vertical sliding motion thereon. A spindle is mounted for horizontal sliding movement relative to the base and for rotation in the fixture. Means are provided for mounting an end mill in one end of the spindle and the spindle is provided with a hand knob mounted for rotation at the other end. The device includes a motor with its shaft position parallel to the base and at an angle of about 80° to the axis of the spindle. Also provided are compound threaded means for moving the motor and grinding wheel toward and away from one end of the spindle and there is provided a pointed stylus mounted on the base adjacent the grinding wheel with the point thereof positionable to engage a flute of an end mill to be sharpened.

BRIEF DESCRIPTION OF THE DRAWINGS

The invention will be more fully described in reference to the accompanying drawings herein.

DETAILED DESCRIPTION OF THE INVENTION

Figure 2:
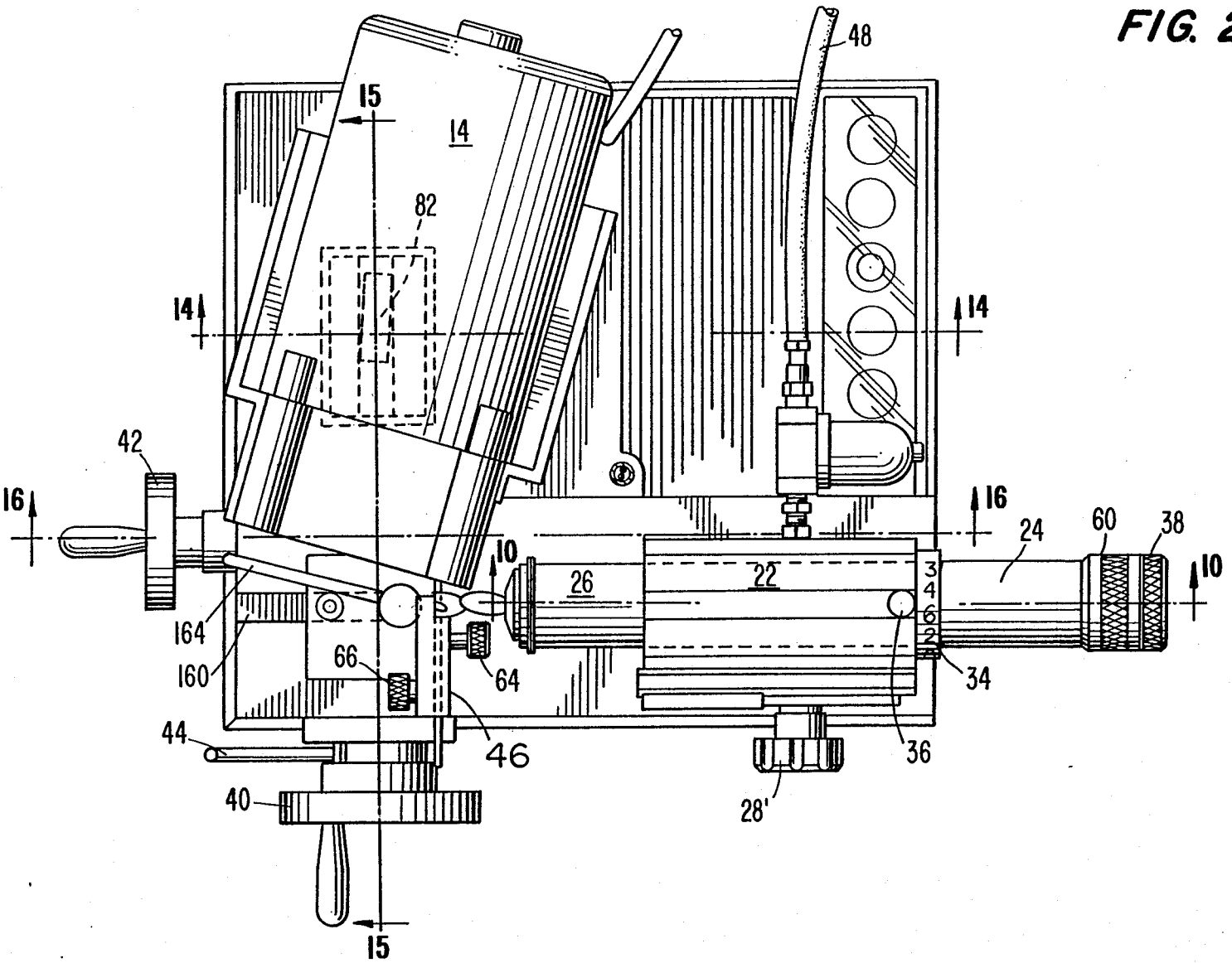
FIG. 2 is a top plan view of the resharpener shown in FIG. 1.
Figure 3:
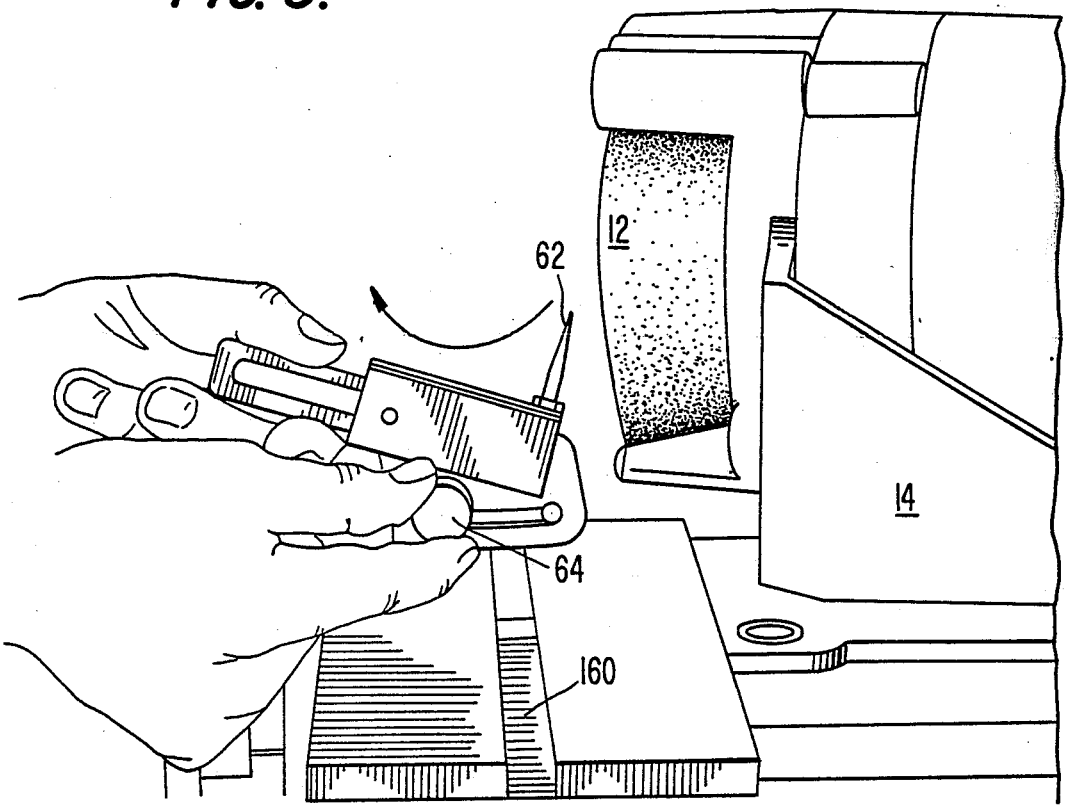
FIG. 3 is a detailed perspective view of the operation of the stylus which controls grinding of the flutes of an end mill.

In reference to the drawings 10 generally designates the end mill resharpener of the invention. The resharpener generally includes a cup shaped grinding wheel 12 mounted on the shaft 72 of a motor 14. The mounting means for the grinding wheel includes a balancing mechanism generally designated 16 to be detailed hereinafter. The motor is mounted on a shaft below the platform 18 and at an angle of about 80° in respect to edge 20 of the base or platform 18 as best seen in FIG. 2. The purpose of this angular mounting of the motor 14 will be discussed in detailed hereinafter. The assembly also includes a housing 22 which carries the spindle 24 having at end 26 means for receiving a collet or chuck 74. The spindle 24 may be raised and lowered in respect to the axes of rotation of the motor 14 by a spindle lever 28 which has a guide pin 30 secured to the housing 22 and which pin rides in an arcuate track 32. The spindle 24 as to be detailed hereinafter is provided with an indexing collar 34 and an index pin 36. At the rearward end of the spindle 24 is rotatable mounted a hand knob 38.

Further, the motor is moved toward and away from this spindle 24 by a cross feed knob 42 and the device is also provided with traverse feed via feed knob 40.

As to be detailed hereinafter, there is provided a clearance handle 44 which moves the motor and its attached grinding cup a fixed distance toward and away from the spindle.

The assembly also includes a stylus 62 having a unique mounting means generally designated 46.

Preferably the spindle 24 is mounted in the housing 22 by means of an air bearing which is provided with compressed air via conduit 48 connected to a source of compressed air not shown in the drawing. Preferably the air bearing is provided with compressed air at about 90 psi.

Figure 4:
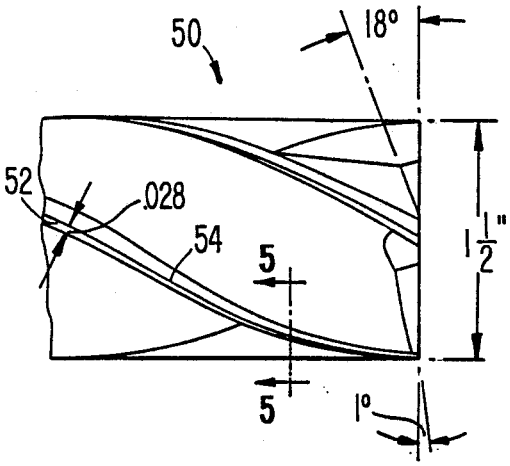
FIG. 4 is a detailed view of an end mill.
Figure 5:
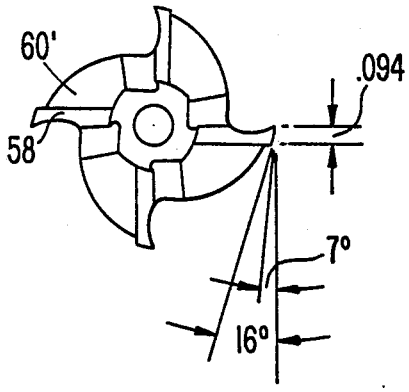
FIG. 5 illustrates the end of a typical end mill.
Figure 6:
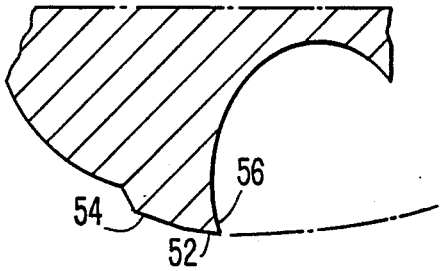
FIG. 6 is an enlarged fragmentary view of a portion of an end mill illustrating the hook, the primary land and the secondary clearance.
Figure 7:
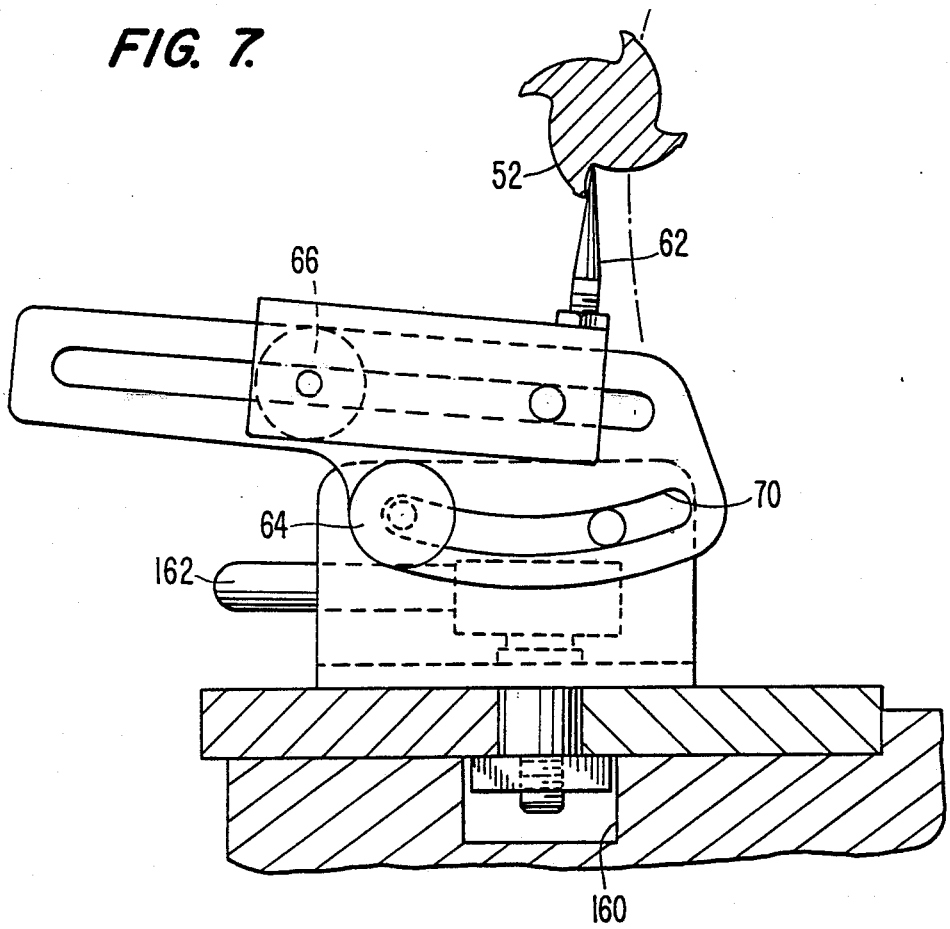
FIG. 7 is an enlarged view of the relationship between a flue on an end mill and the stylus.
Figure 8:
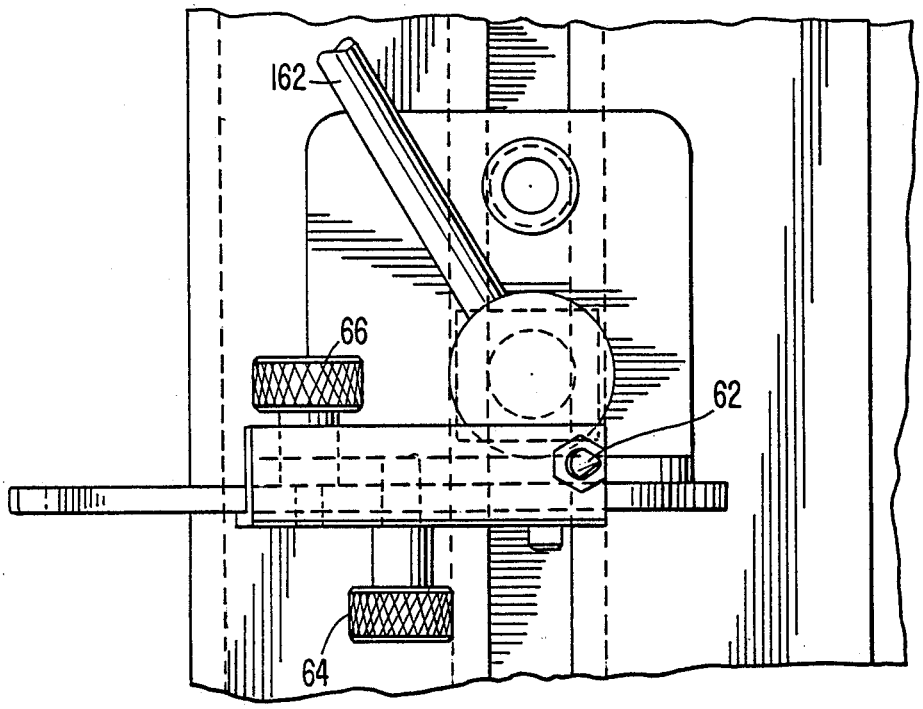
FIG. 8 is an enlarged, view of the adjusting means for the stylus.

Referring now to FIGS. 4, 5 and 6, there is illustrated a general purpose end mill 50 having 4 flutes as more clearly shown in FIG. 5. Each flute has a primary clearance 52 and a secondary clearance 54. The point at 56 is known as the end mill hook.

Likewise, the end of the end mill has a primary cutting surface 58 and a secondary clearance at 60'. It will also be noted that from the primary clearance 52 the mill is cut inwardly one or two degrees to the center of the end mill so that most of the cutting at the end of the end mill is at the outer periphery of each flute.

In resharpening a standard end mill the proper size collet 74 is inserted in end 26 of the spindle 24 and the end mill to be resharpened is inserted up to the flute. The draw bar is then tightened by knob 60 inboard of the rotatable end piece 38. The stylus 62 is positioned in its "primary" position as follows. The fixture 46 carrying the stylus is brought down and away as far as it will go by loosening hand nut 64 which rocks the stylus upwardly to engage a flute 52 as illustrated in FIG. 6. The size adjusting hand nut 66 is loosened and the stylus is slid in and out so that it guides the vary outside edge of the end mill flute, both knobs 64 and 66 are then tightened. Using the cross feed knob 42 the grinding wheel is positioned so that the stylus is aligned with the outer most corner of the grinding wheel. Then using the feed knob 40 the grinding wheel is backed away from the stylus. Thereafter, using the easy-pull knob 38 the spindle is pulled back slowly until the end mill falls off the stylus. The end mill is replaced on the stylus as close to the shank of the end mill as possible. The motor is then energized and again employing the hand knob 40, which moves the motor and grinding wheel, the grinding wheel is urged toward the end mill until sparking just begins. Then the end mill is pulled away through the use of the easy-pull knob until the end mill falls off the tip of the stylus 62. After sharpening the first flute, the clearance handle 44 is rotated counterclockwise to move the grinding wheel away from the end mill.

Each of the remaining flutes are resharpened following the above-detailed procedures.

The secondary angle is resharpened only if the primary becomes too wide to be an effective cutting tool. To carry out the resharpening of the secondary angle of each of the flutes the motor is backed away using the hand wheel 40. The stylus is then moved into the secondary grinding position by loosening knob 64 and rocking the fixture up and back, that is clockwise as far as possible as determined by the track 70 on the fixture, FIG. 5. This drops the stylus position and sets the tool for the secondary grinding. Each flute is positioned on the repositioned stylus and the grinding wheel is moved to just engage the end mill. Again by pulling on the easy-pull knob 38 the secondary angle is resharpened. This procedure is followed for each of the flutes.

In sharpening the end of the mill, the indexing collar 34 is moved forwardly toward the spindle fixture until the index pin 36 can drop into the hole marked with a number that corresponds with the number of flutes on the particular end mill. With the pin engaged in the indexing collar, the spindle is positioned so that the end mill just engages the outside corner of the grinding wheel. The end mill is positioned with the first flute horizontal and is maintained there by the index collar locking knob 80. Using the feed knob 40 the grinding wheel 12 is advanced until the edge of the wheel reaches the center of the end mill. The wheel is then backed away and the indexing pin is lifted and the spindle is rotated to the next index position for grinding of the next flute.

In order to sharpen the secondary angle on the end of the mill, the spindle lever locking knob 28, is loosened and the spindle and its housing are placed in their lowest position. In the lowered position, each of the ends of the mill are resharpened to account for the secondary angle 60', FIG. 4.

The lower block 82 is mounted to the arbor 86 at a slight angle of about 1° off center as shown in FIG. 2. The off angle is from left to right when viewed from front and the top downwardly, again as shown in FIG. 2. Thus as shaft or arbor 86 is moved forward or backward the motor actually rotates toward or away from the end of an end mill being resharpened automatically producing the two degree fish tail without the necessity of tilting the motor in respect to the spindle. By dropping the spindle, the angel of approach of the end of the mills and the grinding wheel are correspondingly changed to give the secondary end angle.

Motor Mount

Referring to FIGS. 14 through 17 taken on lines 14—14, 15—15 and 16—16 of FIG. 2 the motor housing and motor designated 14 are bolted via a pair of blocks 82 and 84 to a shaft or arbor 86 via a pair of studs 92. The arbor can slide and rotate in bearings 88 and 90. The lower block is in contact via roller 128 to a lever 114. Hand wheel 40 is splined to a short hollow shaft 100 which has threaded connection with the threaded portion 98 of shaft 86. Rotation of the hand wheel 40 in one direction moves the motor in a forward direction and the reverse rotation of hand wheel 40 moves the motor in the opposite direction. A helical spring 102 is partially received in a bore 104 in the shaft 86 and the spring bears against housing endwall 106 at one end and the end of the bore 104 a the opposite end, thereby urging the shaft 86 toward the handle 40.

As hereinbefore described, the feed mechanism includes a clearance handle 44. The clearance handle 44 is connected to a hollow shaft 108 through which is fitted the feed screw nut 101. One end of the hollow shaft 108 is provided with a courser thread than the threads on shaft 98 which screws into the screw nut 101. By pressing the clearance handle in a counter-clockwise direction the shaft 108 pushes against the thrust bearing 101, which pushes against the feed screw nut forcing the feed screw/shaft and therefore the motor in a rearward direction a fixed distance against the coil spring 102. When the clearance handle is released the torque spring 111 turns the shaft back to its starting position causing the motor and shaft 86 to move forwardly the same distance the motor was.

Figure 15:
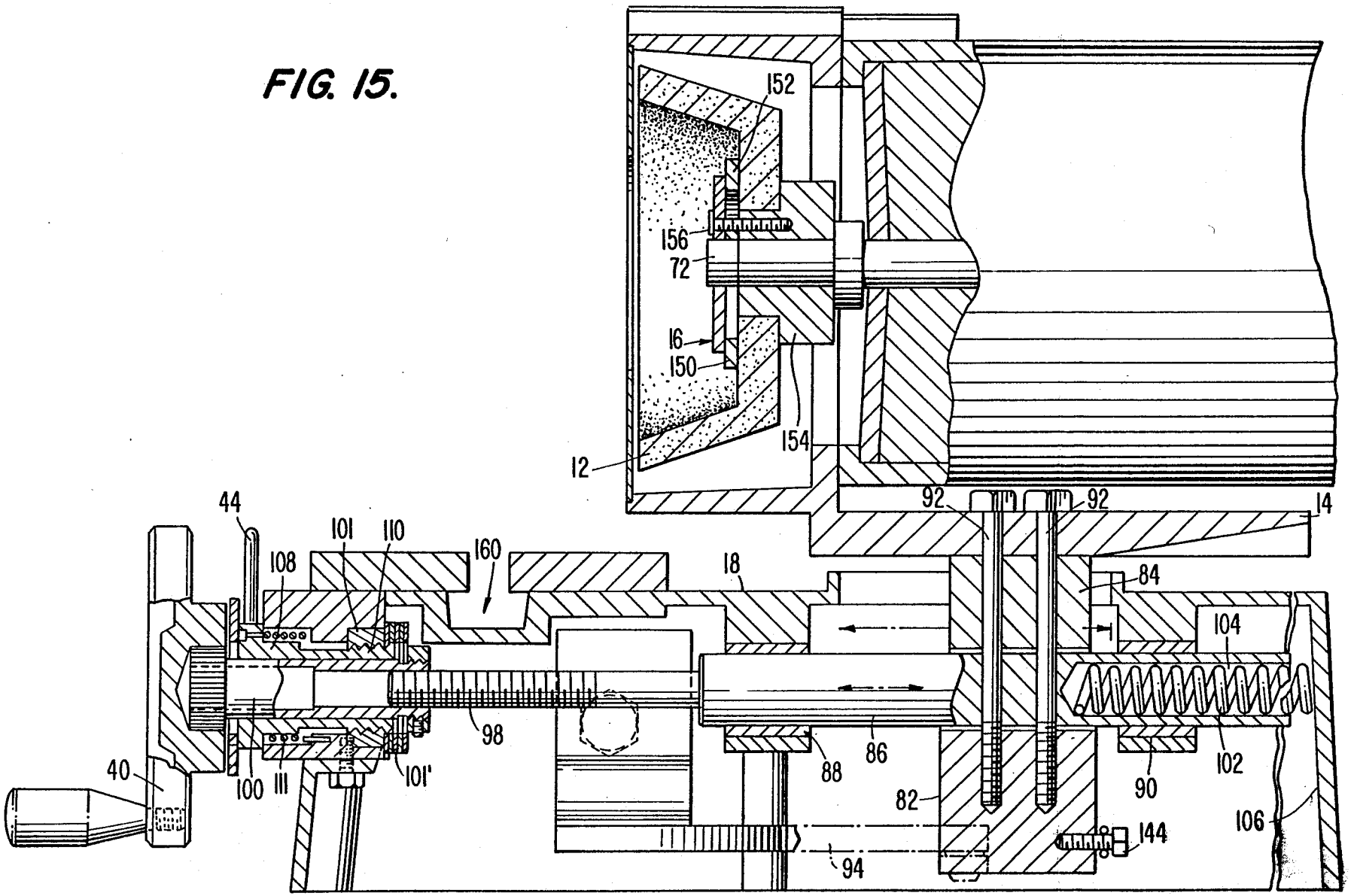
FIG. 15 is a section on line 15—15 of FIG. 2.
Figures 16, 17:
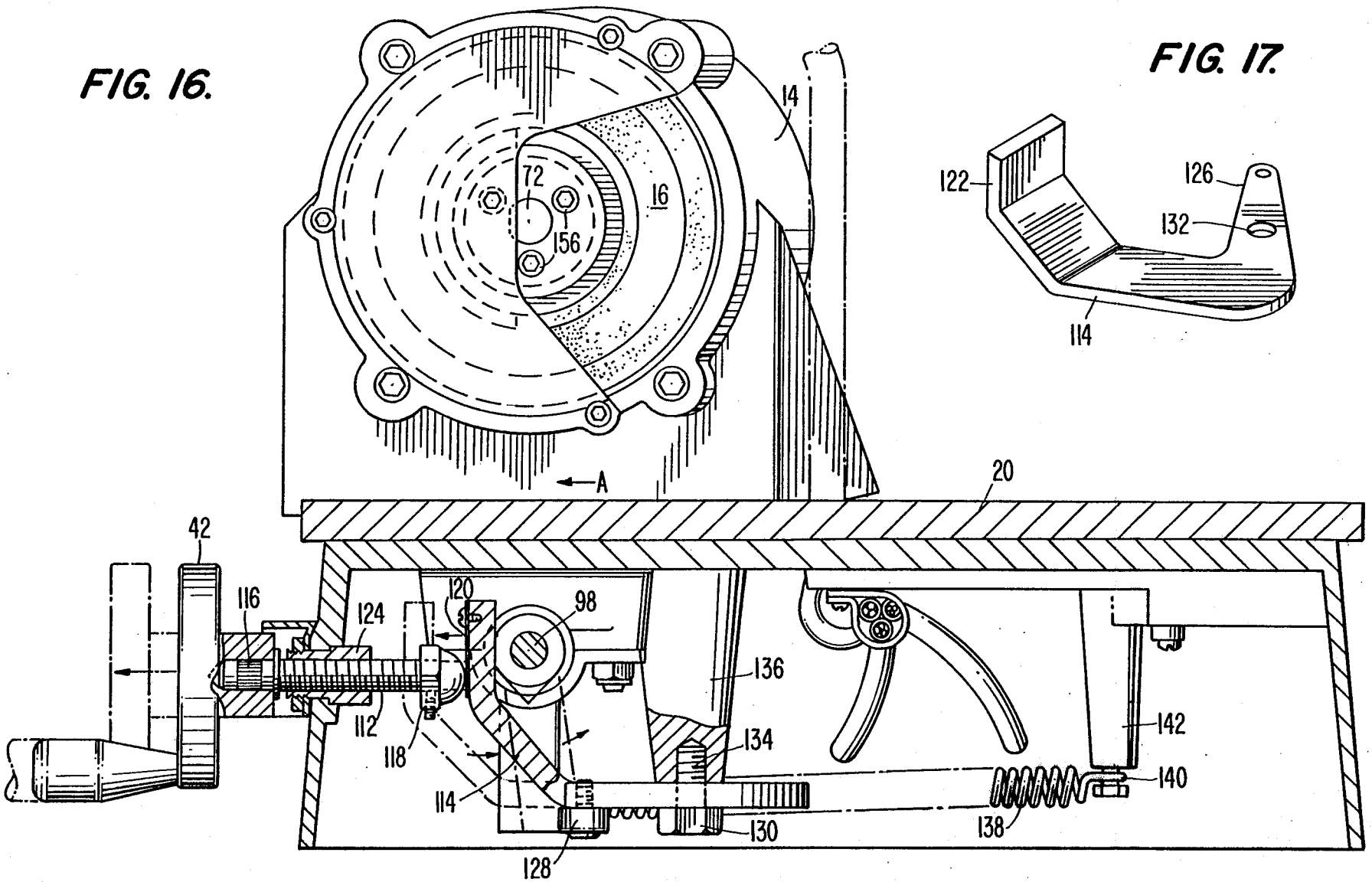
FIG. 16 is a section on line 16—16 of FIG. 2.
FIG. 17 is a perspective view of the cross feed bell crank.

Referring now particularly to FIGS. 16 and 17, cross feed for the resharpening device is brought about by rotating the motor and housing 14 about the support shaft 86. The rocking motion is via the cross feed knob 42 its connected threaded shaft 112 and bell crank 114. The hand wheel 42 is splined as at 116 to the shaft 112 and at the opposite end there is pinned a pusher member 118. The pusher member rides against a wear plate 120 connected to upstanding ear portion 122 of the bell crank 114. The bell crank moves when the hand wheel 42 is rotated in the fixed threaded bushing 124 as illustrated in full and broken lines in FIG. 16. This movement is converted into pivotable movement of end 126 which carries a roller 128. The rocking motion is via the pivot bolt 130 which passes through the bore 132 of the bell crank 114. The threaded end 134 of the pivot bolt 130 is threaded into a portion of the main housing casting 136. A helical spring 138 is anchored at one end 140 to casting portion 142 and the other end is connected to the lower block 82 via bolt 144, FIG. 15 of the drawing, thus there is a constant tension via spring 138 tending to urge the motor housing in the "X" direction as shown by directional arrow A, FIG. 16 where opposite direction motion is brought about by the hand wheel 42 pressing on wear plate 120. The roller 128 bears against the block 82 as shown in FIGS. 15 and 16.

From the foregoing it will be seen that the motor is mounted on a single arbor such that movement of the motor in both the "X" and "Y" directions is accomplished from the single arbor and wherein means are provided on the same arbor, to cause the motor to move at a slight angle, while it is moved in the "Y" direction, causing the angled "fish-tail" to be automatically produced while grinding the end of the end mill.

It is general machine terminology to describe "Y" movement as movement towards and away from the operator of the machine as he faces it. "X" movement is to the left and right of the operator.

Grinding Wheel Balancing

It is desirable that the grinding wheel 12 be accurately balanced to reduce to a minimum imperfections in regrinding end mills. Balancing is simply accomplished by means of a balancing washer 150, FIGS. 15 and 16, which washer has a larger opening 152 than the diameter of shaft 72 of the motor. The grinding wheel 12 is connected to the grinding wheel hub 154 by three bolts 156 which pass through the large opening in the balancing washer 150 and make threaded connection in the hub 154. By loosening the three studs 156, the balancing washer 150 may be physically moved eccentrically of the shaft 72 and via trial and error the grinding wheel may be accurately balanced reducing to a minimum, vibration when the motor is engaged. Between each slight movement of the balancing washer 150 the studs 156 are tightened, the motor engaged and the assembly tested for balance.

Miscellaneous Features

Figure 1:
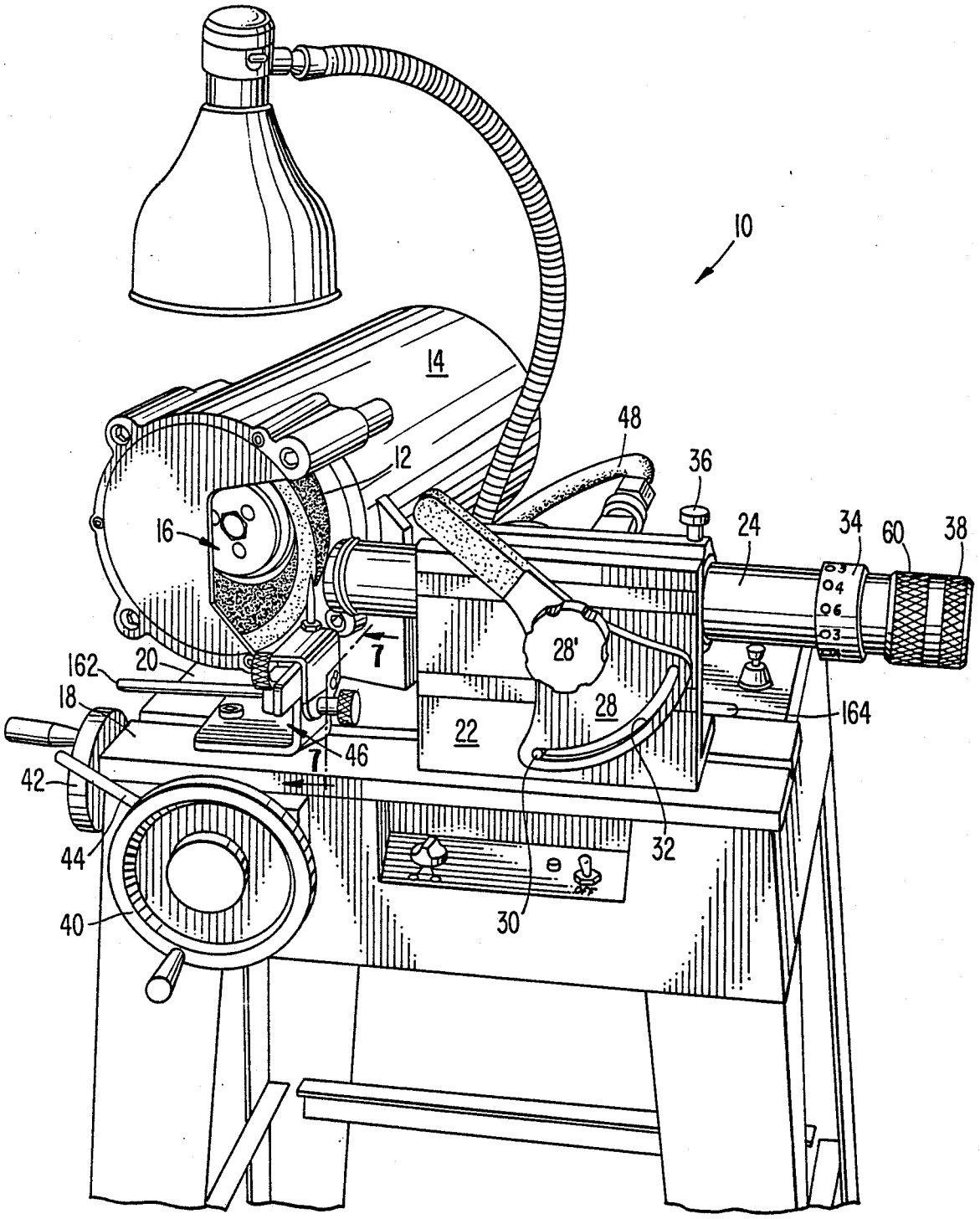
FIG. 1 is a perspective view of the end mill resharpener of the invention.
Figure 9:
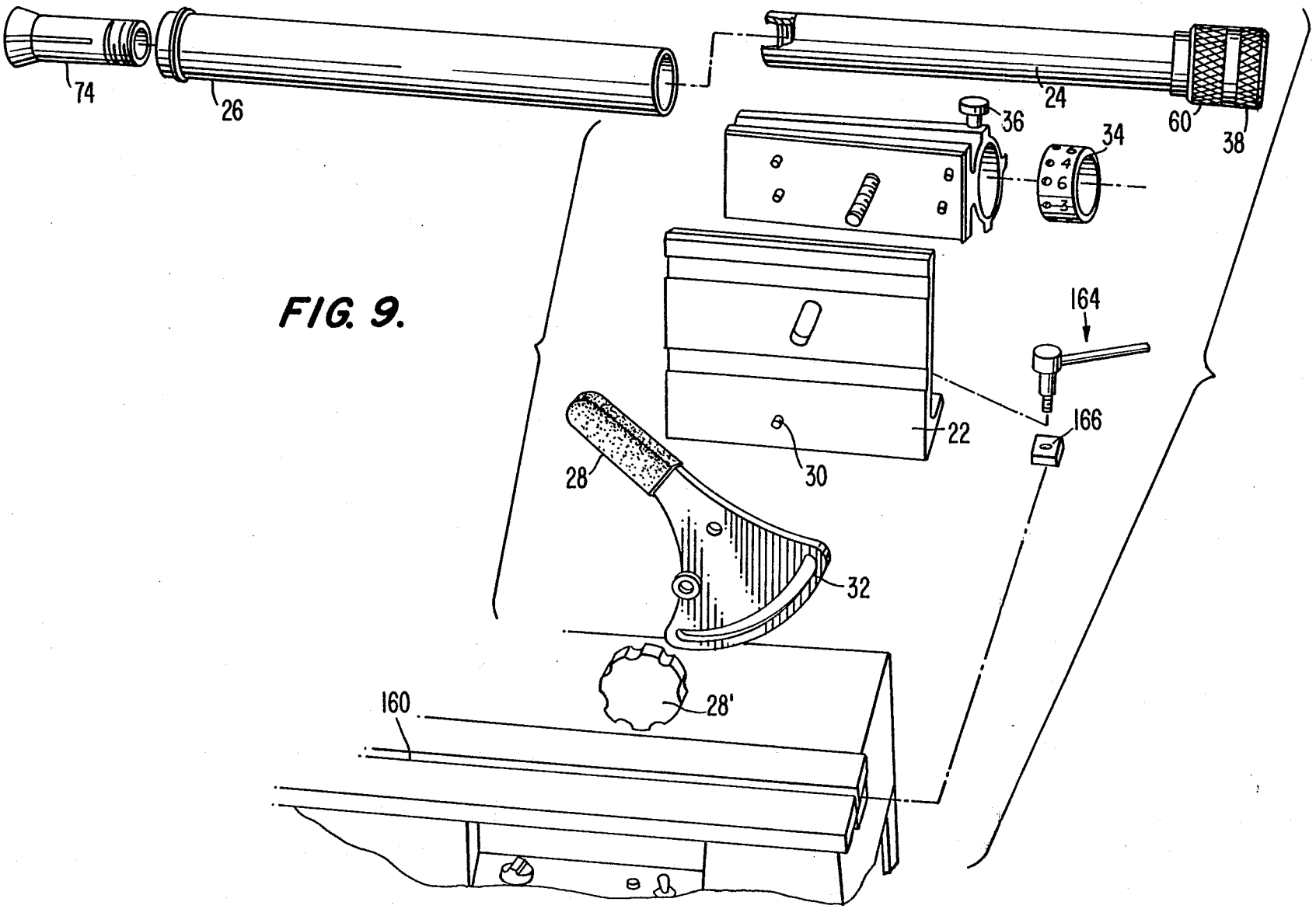
FIG. 9 is an exploded view the fixture and spindle.
Figure 10:
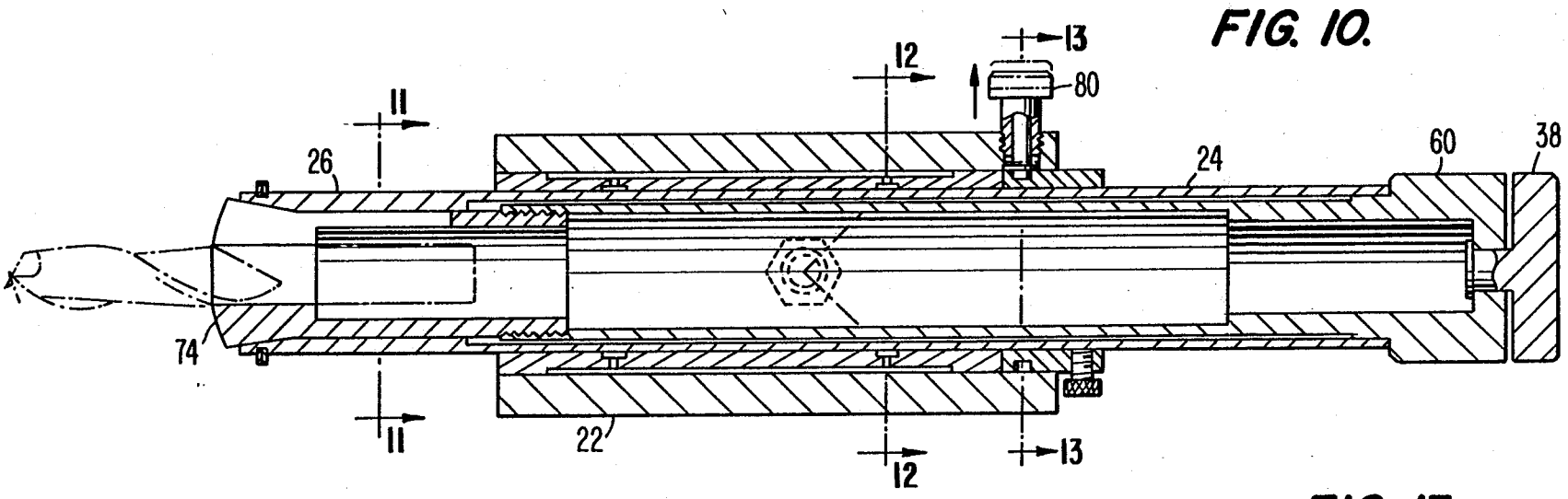
FIG. 10 is a sectional view of the spindle and spindle housing on line 10—10 of FIG. 2.
Figure 13:
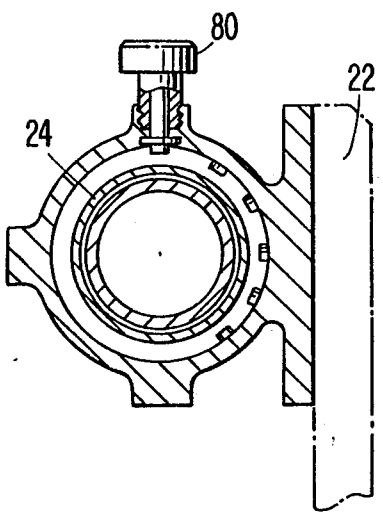
FIG. 13 is a section on line 13—13 of FIG. 10.
Figure 12:
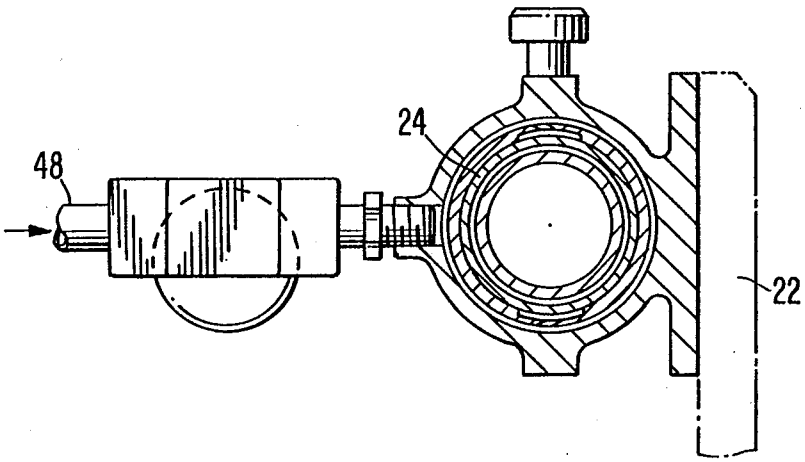
FIG. 12 is a section on line 12—12 of FIG. 10.
Figure 11:
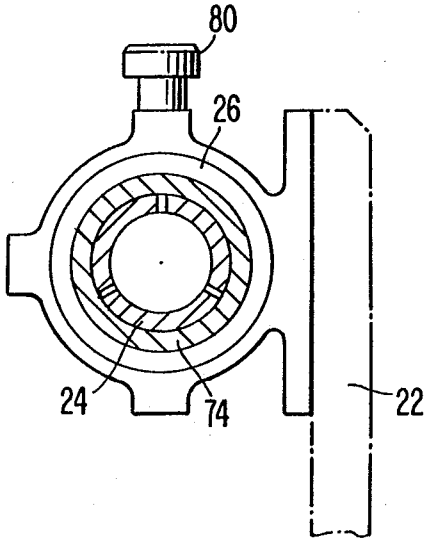
FIG. 11 is a section on line 11—11 of FIG. 10.
Figure 14:
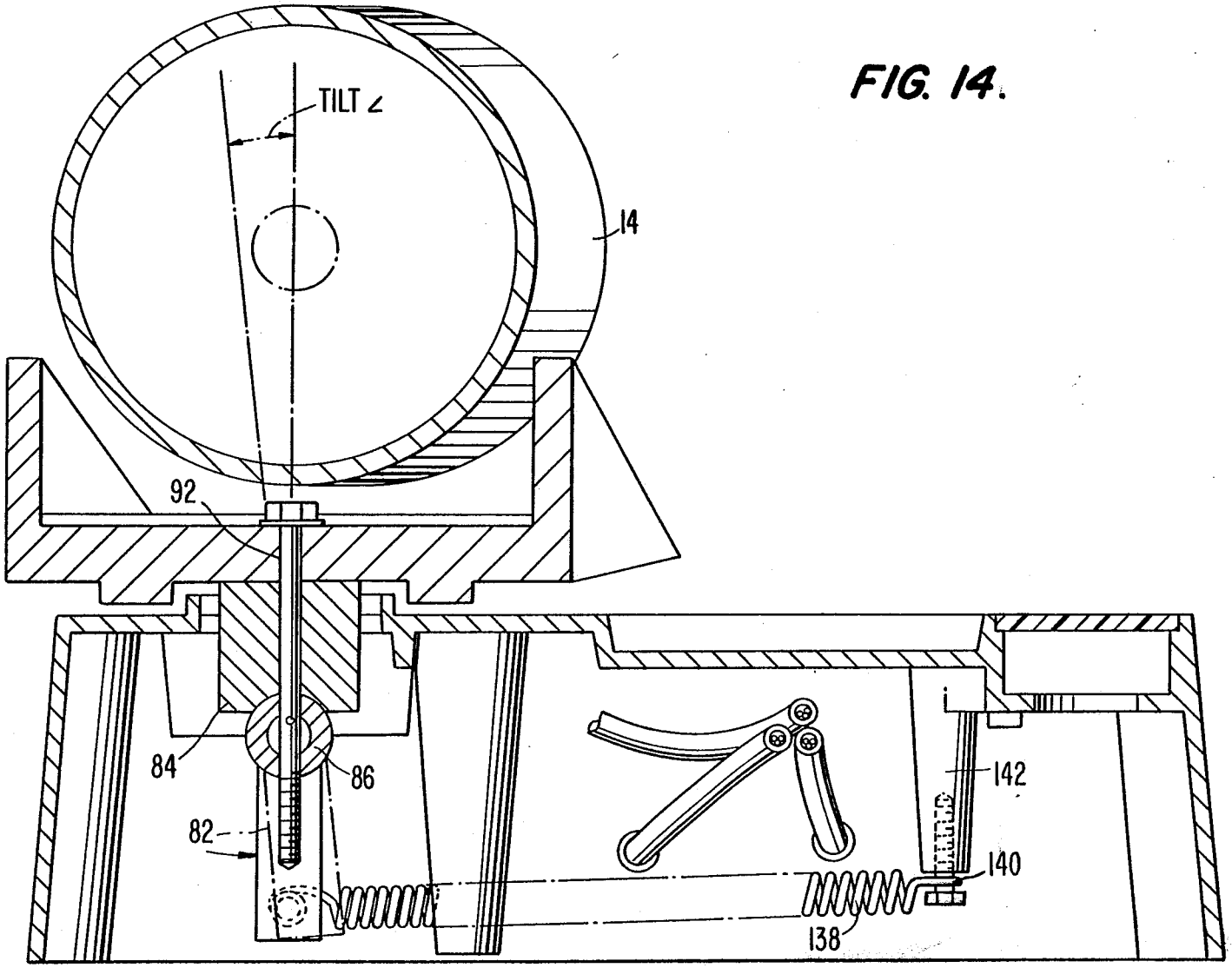
FIG. 14 ls a section on line 14—14 of FIG. 2.

The stylus mount 46 and the mount 22 for the spindle are each mounted via a T-slot 160 best shown in FIG. 15 so that the stylus mount 46 may be properly positioned by loosening the bolt via handle 162 FIG. 1. Likewise the support 22 for the spindle may be moved toward and away from the grinding wheel by handle means generally designated 164 and the nut 166 fitted in the lower portion of the T-slot 160 as illustrated in FIG. 9. From the foregoing description it will be apparent to those skilled in the art that the regrinding mechanism for end mills has features and improvements not available in prior art end mill regrinding devices.

We claim:

1. An end mill resharpening device comprising a base, having a fixture mounted for vertical sliding motion thereon;

a spindle mounted for horizontal sliding movement relative to the base and for rotation in the fixture;

means for mounting an end mill in one end of the spindle;

a means for mounting a motor on the base, with its shaft positioned parallel to the base, and its shaft positioned at an angle to the axis of the spindle;

threaded means for moving the motor, and an attached grinding wheel toward and away from one end of the spindle; wherein the mounting means for the spindle comprises an air bearing, and the spindle is provided with a hand knob mounted for rotation at the end of the spindle opposite the end mounting the end mill; and further including a means for mounting a pointed stylus on the base adjacent the grinding wheel with the point thereof positioned to engage a flute of an end mill to be sharpened wherein the mounting means for said stylus includes means for compensating for end mill diameter and means for automatically setting the stylus for primary and secondary angle resharpening.

2. The end mill resharpening device as defined in claim 1, wherein the motor shaft is positioned at an angle of 88° to the axis of the spindle.

3. The end mill resharpening device as defined in claim 1 wherein the fixture mounting the spindle is vertically movable relative to the grinding wheel for resharpening the primary and secondary angels on the end of an end mill.

4. The end mill resharpening device as defined in claim 1 wherein the means for mounting the motor comprises a shaft mounted in bearings for sliding motion toward and away from the spindle and means are provided for tilting the motor about axis of said shaft to provide cross feed relative to an end mill mounted in the spindle.

5. The end mill resharpener as defined in claim 1, wherein the mounting means for the stylus and the mounting means for the spindle are adjustable mounted relative to the grinding wheel.

6. The end mill resharpening device as defined in claim 1, wherein the motor includes a shaft and a means for mounting a cup shaped grinding wheel on said shaft.

7. The end mill resharpening device as defined in claim 6, wherein the mounting means for the cup shaped grinding wheel includes a metal washer having a bore larger than the motor shaft and means for moving the said washer for balancing the cup shaped grinding wheel.

8. The end mill sharpening device, as defined in claim 1, wherein said threaded means for moving the motor and grinding wheel toward and away from one end of the spindle includes a hand-operated handle connected to a hollow shaft, a torque spring surrounding the hollow shaft, a feed screw nut threaded to the end of the hollow shaft, the feed screw nut and the threaded end of the hollow shaft having coarser threads than threads on the threaded means for moving the motor toward and away from said one end of the spindle, whereby when the hand-operated handle is moved in one direction the motor and its attached grinding wheel are rapidly urged away from the spindle.

9. The end mill sharpening device, as defined in claim 1, wherein said threaded means for moving the motor and grinding wheel toward and away from one end of the spindle includes an arbor positioned below the motor shaft, a lower block depending from the arbor and studs connecting the motor, the arbor and the lower block together, wherein the lower block is positioned at a slight angle to the longitudinal axis of the arbor, a cam follower engaging said lower block to move the motor and grinding wheel to the left and right as the motor moves towards and away from the spindle to produce and angled fishtail during grinding of the end of the end mill.

10. An end mill resharpening device comprising a base having a fixture mounted for vertical sliding motion thereon;

a spindle mounted for horizontal sliding movement relative to the base and for rotation in the fixture;

means for mounting and end mill in one end of the spindle;

a motor with its shaft positioned parallel to the base and its shaft positioned at an angle to the axis of the spindle;

threaded means for moving the motor and an attached grinding wheel toward and away from one end of the spindle;

including a stylus fixture, provided with means to automatically adjust the position of the end mill such that the proper primary and secondary angle are produced while grinding the sides of the end mill.

11. The end mill resharpening device as defined in claim 10, wherein said stylus adjustment is produced by both an adjustable, angled, sliding means to compensate for different end mill diameters and also by providing an adjustable arc motion, so that both primary and secondary angle can be ground on the side of the end mill.

* * * * *